US007927239B2

(12) United States Patent
Bothwell

(10) Patent No.: US 7,927,239 B2
(45) Date of Patent: Apr. 19, 2011

(54) SUBSTANTIALLY FLUID TIGHT GAME RACKET INCLUDING A SPRING SUSPENSION MODULE

(76) Inventor: Brett Bothwell, New York, NY (US)

( * ) Notice: Subject to any disclaimer, the term of this patent is extended or adjusted under 35 U.S.C. 154(b) by 420 days.

(21) Appl. No.: 11/986,828

(22) Filed: Nov. 26, 2007

(65) Prior Publication Data

US 2009/0137351 A1 May 28, 2009

(51) Int. Cl.
*A63B 49/02* (2006.01)

(52) U.S. Cl. ..... 473/521; 473/540; 473/548

(58) Field of Classification Search ..... 473/520–522, 473/534, 539, 540, 543
See application file for complete search history.

(56) References Cited

U.S. PATENT DOCUMENTS

| | | | | |
|---|---|---|---|---|
| 360,468 | A * | 4/1887 | Phelps | 473/534 |
| 5,368,297 | A * | 11/1994 | Liu | 473/539 |
| 5,458,331 | A | 10/1995 | Bothwell | |
| 6,071,203 | A | 6/2000 | Janes et al. | |
| 6,503,161 | B2 * | 1/2003 | Bothwell | 473/540 |
| 6,530,851 | B2 * | 3/2003 | Munster | 473/521 |
| 6,800,239 | B2 | 10/2004 | Davis | |
| 6,971,964 | B1 | 12/2005 | Bothwell | |
| 7,104,905 | B2 * | 9/2006 | Schwenger et al. | 473/521 |
| 2002/0039937 | A1 * | 4/2002 | Bothwell | 473/520 |
| 2009/0017948 | A1 * | 1/2009 | Ashino | 473/522 |
| 2009/0137351 | A1 * | 5/2009 | Bothwell | 473/521 |
| 2009/0215558 | A1 * | 8/2009 | Bothwell | 473/540 |

* cited by examiner

*Primary Examiner* — Raleigh W. Chiu

(57) ABSTRACT

A game racket frame is provided including at least one substantially fluid tight portion. The racket includes a handle and a head frame with strings laced through and held in tension to form a stringed hitting surface. Alternatively, the game racket of the present invention could be formed of at least one substantially fluid tight part including a handle portion and a head frame portion. The head frame includes at least one substantially fluid tight portion and has at least one unitary multi-component spring suspension module disposed on its periphery to cooperate with at least one string. The profile of the generally tubular, spring suspension module is formed by at least two components, having at least one common wall. The profile includes a first side portion and a second side portion, is closed on at least two ends, and can have at least one communicating means in common with the racket. Alternatively, when the racket is comprised of more than one substantially fluid tight part, there can also be at least one communicating means located on at least one common surface between the parts to form the substantially fluid tight game racket of the present invention.

32 Claims, 10 Drawing Sheets

SUBSTANTIALLY FLUID TIGHT GAME RACKET INCLUDING A SPRING SUSPENSION MODULE

FIELD OF THE INVENTION

The present invention is intended for use as a game racket including a handle and a head frame with strings held in tension. In particular as a high performance game racket frame including at least one substantially fluid tight head portion that can communicate with at least one spring suspension module to cooperate with at least one string.

BACKGROUND INFORMATION

The field of sports racket design has changed dramatically in its recent history. Major improvements in the area of reinforced plastic fabrication have made possible a number of significant improvements in high performance game rackets.

Improved strength of bonding agents and related "co-curing" and "re-curing" molding processes make it possible to have reinforced plastic rackets made up of multiple parts and/or components that can be bonded and/or "co-cured" together to form a racket frame element or a racket frame. Previous concerns regarding the long term durability of multi-part and multi-component construction and its capacity for withstanding the most rigorous performance standards, are no longer a problem. The superior strength that can be achieved is now well beyond that needed for structurally sound, and long lasting products. It's now possible to have not only a high performance multi-part game racket frame, but also to have a high performance game racket frame with a multi-component frame profile.

There are a number of high performance multi-part racket designs currently in use. The term multi-part being used here to describe a racket that is formed of previously molded parts that are bonded together. The parts can be one or a combination of portions including a handle portion and a head portion in order to make a complete racket frame. One good example of this is a design in which a handle portion is molded together with a throat portion in a conventional inflation bladder mold to form one part. That part is then bonded to a head frame part which has also been molded separately in a typical manner. This particular design relies on a rubber gasket to isolate the two parts with the intended purpose being to reduce the amount of shock and vibration transmitted to the handle.

Another multi-part high performance racket design made up of two separate parts bonded together is one in which a head frame portion and a throat portion are molded as one part. That part is then bonded together with a separately molded handle part to form a complete racket frame. This design also uses a rubber gasket for isolation situated between the two parts in order to achieve improved dampening properties.

The same improved bonding agents and related curing processes that make a multi-part frame possible, can also be employed to produce multi-component racket frame profiles. one or more separate, generally tubular components can be "pre-molded", bonded together and then "re-cured" to form a structurally contiguous, unitary frame profile or, the generally tubular components can also be "pre-formed" together in a mold and "co-cured" to form a structurally contiguous, unitary frame profile. It's also possible to pre-mold a separate component and then co-cure it together with at least one other pre-formed component.

A number of current racket designs can be found having a multi-component frame profile. One in particular is described by U.S. Pat. No. 6,071,203. The frame profile of this game racket is a generally tubular "two-component" design that can be achieved with one of the methods described above. One or both of the two components can be pre-molded, bonded together and then re-cured to make a structurally contiguous unitary frame profile, or the components can be pre-formed together in a mold and then co-cured to form a unitary frame profile. The game racket frame profile by either one of the fabrication methods results in improved racket performance. The common bonding wall between the components forms an internal rib which stabilizes the head frame and stiffens the racket. The result is a larger sweet spot and a more responsive racket.

Improved bonding agents and related curing processes also make one other critical improvement in game racket design possible—"pre-formed" string channel openings. In the previous art of U.S. Pat. No. 6,071,203, joining the two components of the frame profile can result in pre-formed string hole openings or "channels for the strings", by virtue of their mating configuration. The implications for racket performance are substantial. One very important implication is that the previously accepted method of drilling string holes through a racket frame after it has been molded, can be eliminated. Now openings in the head frame for strings to be laced through as in the conventional way, can be made smooth and therefore protective string grommets can be eliminated too. The resulting stringbed has an enlarged sweet spot due to its capacity for the string to move freely from the outside surface of the head frame profile. The racket is also inherently lean, responsive and easy to balance.

Another method for producing a pre-formed string channel opening that relies on the latest techniques of reinforced plastic fabrication using inflation bladder molding is described by U.S. Pat. No. 6,800,239. The racket as it's described can be made with spacers or "pins" inserted between two pre-formed components and then co-cured in a mold together to form a frame profile with a through channel for the lacing of the strings. The spacers are used to create openings in the flatter portions of the head frame periphery, and the pins are used to create openings on the portions of the head frame periphery through which the strings are often laced at difficult angles. Once again the great benefit is that protective string grommets are made unnecessary due to the controlled fabrication of string hole openings through the head frame profile. The string therefore moves more freely, and the additional weight of a protective grommet can be eliminated.

In spite of the many improvements to racket performance offered by the previous art as derived from these new fabrication techniques, there is one aspect of the potential that hasn't yet been exploited or even cited by the previous art as a potential performance enhancing quality—a game racket frame and/or parts of a frame, and/or components of a frame profile can be made to be substantially fluid tight. Improved bonding agents and related curing processes make it possible to have at least one substantially fluid tight racket frame part or frame profile component, even with strings laced through the head frame in a typical manner. More specifically, no previous art has cited the potential for a game racket with at least one substantially fluid tight part and/or frame profile component, as it relates to a suspension system or sectors of a system located on at least a portion of its head frame and therefore acting directly on the strings. The potential for improving racket performance is significant if a game racket frame with at least one substantially fluid tight portion or alternatively a racket frame with at least one substantially fluid tight part including a handle portion and a head frame portion, could be utilized to inform the spring quality of the stringed hitting area. It would be a further improvement to have a game racket frame with at least one substantially fluid tight portion or a racket frame with at least one substantially fluid tight frame part with strings laced through, that can inform the response characteristics of at least one multi-component spring suspension module located on at least one portion of the head frame to cooperate with at least one string.

If the objective then is to make a game racket with at least one substantially fluid tight part or head frame portion with a generally tubular profile and being laced through with strings in the conventional manner, there is at least one more way to do it that is facilitated by the same fabrication techniques as described above. The string holes of this design are drilled however, as in the previous commonly accepted method, and therefore a protective string grommet is required. The frame profile can have at least two generally tubular components that are spaced apart and away from a string hole location such that when a string hole is drilled through the molded frame, the substantially fluid tight quality of the other component(s) remains intact. Though the responsiveness of the string in this design is generally inferior to a grommetless design, it can have merit, due to its substantially fluid tight potential, in facilitating string suspension designs that rely on fluid retention.

In the context of these vastly improved bonding agents, related curing processes and far more flexible inflation bladder molding techniques, which enable the fabrication of a substantially fluid tight racket part and/or frame profile and frame profile component, even with strings laced through in the conventional manner, significant improvements in string suspension designs that rely on fluid retention can be achieved.

The game racket of U.S. Pat. No. 5,458,331, employs a string suspension system utilizing a fluid chamber to dampen shock, improve the string response, and to adjust the string tension. A number of features of this design make it generally too heavy. One reality of its fabrication using conventional manufacturing methods is drilled string holes. Having string holes that pass through the chamber and the head frame, essentially requires a bladder in order to maintain pressure. The weight and balance are difficult to reconcile and the performance of the racket suffers.

Another unfortunate reality of this design is that in order to maintain bladder pressure, the bladders must be part of a closed loop and therefore continuous around the racket head. Though the continuous chamber is ideal in that it affords a stringbed that is uniformly responsive across its entire surface, the design is hampered by the extra weight of the additional bladder length required. Adding to the complexity of making this design with conventional methods, is the "internal plumbing" required to retain pressure within the racket frame. Not only is the plumbing required to maintain pressure, but it is also required to afford a connection to a conveniently located control means on the frame. It would be a great improvement in the design of sports rackets with string suspension systems to eliminate the "internal plumbing" required for fluid retention and for the accommodation of control means. It would also be advantageous to have a game racket with at least one substantially fluid tight portion and/or part and/or frame profile component, whereby a suspension system, or sectors of a system, can be plugged directly into a fluid retaining vessel that is the racket or at least, a portion or part of a racket. It would also be very beneficial to have a suspension system, or sectors of a system, that plug directly into at least one substantially fluid tight head frame profile component, thereby eliminating the need for a continuous loop around the head frame and providing a means for segregating the interior volume of the generally tubular frame profile. This capacity for segregating the fluid retaining internal volume of the generally tubular frame profile is yet another improvement afforded by new methods that can enable a control means that is conveniently located and implemented with maximum efficiency.

Although one of the novel features of the racket in U.S. Pat. No. 5,458,331 is the adjustable tensioning feature, it is also has drawbacks in its performance. Though the tension of the strings can be changed by adding or withdrawing fluid from the chamber, the magnitude of required pressure is so great that performance adjustment of the racket is limited specifically to changing the string tension alone and not changing the spring quality of the suspension system itself. It would be a truly novel quality in a high performance game racket frame to be able to adjust the stiffness or spring quality of its string suspension system during a pause in play. It would be a great improvement in the design of a string suspension system to have a system or sectors of a system, with adjustable spring characteristics that are attainable by changing the fluid pressure qualities within a substantially airtight racket head frame on which a suspension system or sectors of a system, can be located.

Another string suspension-type design that can rely on pressure retention for its performance traits is the spring element of U.S. Pat. No. 6,971,964. It teaches the benefits of combining a dampening element with a load bearing resilient casing in order to reduce the pressure on the dampening element and therefore to effect more directly, the spring quality of the stringbed. Though the spring response of the element is very good, this design also can be difficult to achieve. The ideal version of the spring element is one that can retain pressure. Because the conventional molding method requires the drilling of string holes through the casing after it's removed from the mold, it's a technological challenge for the spring to retain pressure without either an internal molded cavity which remains intact through the drilling process, or a bladder. And though the internal cavity is achievable by a conventional inflation bladder molding method, it's difficult to control the thickness and therefore the flex response of the internal wall(s). The drilling process of conventional methods also makes it difficult to reduce the weight, requiring protective string grommets be used in the string holes of the outer casing. It would be advantageous over the previous art to have a multi-component, spring suspension module, thereby eliminating the need for a bladder and/or the uncontrollable process of forming an internal wall. It would be another great improvement to have a substantially fluid tight, multi-component, spring suspension module profile that is fabricated with pre-formed string channel openings so that the drilling of string holes through the casing could be eliminated. It would be another great improvement over the previous art to have a multi-component spring suspension module that is fabricated in such a way as to eliminate the additional weight of protective string grommets.

Though the spring element of U.S. Pat. No. 6,971,964 as described is a very effective way to dampen shock at the strings and to enhance the spring quality of the stringbed, there is no mention of its capacity for adjustability. It would be a great improvement over the previous art to have at least one substantially fluid tight, multi-component, generally tubular, spring suspension profile, that is without protective string grommets and that can communicate, i.e. via fluid displacement, with at least one portion of a substantially fluid tight head frame. It would be another improvement over the previous art to have a substantially fluid tight, multi-component, spring suspension module located on at least one substantially fluid tight portion of the head frame such that its stiffness/spring quality can be informed by fluid pressure in the racket.

There is one other issue that plagues any racket frame or racket part requiring the capacity for fluid retention—maintenance. The internal plumbing required in the previous art using conventional fabrication methods is difficult to service if it should spring a leak or if it should happen to come loose inside the tube of a typical frame. If the control means, i.e. valve, should become dislodged in the previous art, it could potentially require replacement of the entire racket frame. It would be a vast improvement over the previous art to eliminate any internal plumbing required for fluid retention. It would be another great improvement to make possible the replacement of one or more individual parts of a multi-part racket frame in order to avoid replacing the entire frame altogether should damage or a malfunction occur.

It is a primary objective of the present invention to improve the performance of a game racket. It is also a primary objective of the present invention to provide a game racket with at least one substantially fluid tight portion or alternatively, a racket with at least one substantially fluid tight part including a head frame, with at least one multi-component, spring suspension module located on at least a portion of a head frame to cooperate with at least one string, that has a weight and balance equal to current high performance racket standards. Another objective of the present invention is to exploit the fluid retention capacity afforded by the latest reinforced plastic molding techniques, as it pertains to a string suspension system or sectors of a system. It is another object of the present invention to exploit the substantially fluid tight potential of a multi-component head frame profile in order to retain fluid pressure while still being laced through with strings. Another object of the present invention is to provide at least one dependent spring suspension module, on the head frame of a fluid pressure retaining racket wherein its spring quality can be informed by fluid pressure in the racket. It is yet another object of the invention to provide a control means by which the pressure in at least one portion of the racket, or at least one part of the racket frame, can be changed, which subsequently changes the stiffness of at least one spring suspension module located on at least one portion of the head frame. Another object is to provide a fluid retaining game racket with strings laced through, that can communicate with at least one substantially fluid tight multi-component spring suspension module mounted on at least one portion of its head frame. It is another object of the present invention to provide a racket with at least one multi-component spring suspension module, that is free of extraneous parts and has optimum overall balance characteristics in keeping with the highest performance standards to date. Still another object is to provide at least one multi-component spring suspension module located on at least one substantially fluid tight portion of the head frame whose performance is not hindered by conventional stringing methods.

To achieve these objects, a game racket including at least one substantially fluid tight portion including a handle and a head frame is provided. Alternatively, a game racket with at least one substantially fluid tight part comprised of at least a handle portion and a head frame portion, can be provided. The head frame has at least one substantially fluid tight portion and has strings laced through and held in tension to form a stringed hitting surface. At least one multi-component, spring suspension module is located on at least one portion of the head frame to cooperate with at least one string. The racket frame and the racket frame profile, can be made from at least one part and/or at least one component and then joined together to form a substantially fluid tight game racket frame. At least one substantially fluid tight portion of the head frame can receive and communicate with, at least one multi-component, spring suspension module. The at least one spring suspension module has a profile comprised of at least two generally tubular components with at least one common wall and utilizes the latest techniques of inflation bladder molding.

BRIEF DESCRIPTION OF THE FIGURES

FIG. 9A is a top view of the module located on a portion of an outer peripheral surface of the head frame. FIG. 9B is a sectional view corresponding to line 9-9 in FIG. 9A showing the multi-component spring suspension module located on a portion of the outer peripheral surface of a three-component head frame that has drilled string hole(s).

FIG. 10A is a top view of the dependent module indicating one of many possible locations for a communicating means. FIG. 10B is a sectional view corresponding to line 10-10 in FIG. 10A showing the dependent module terminating on a head frame portion with pre-formed string channel openings and indicating one of many possible locations for a communicating means.

FIG. 11A shows a top view of the module located on the outer peripheral surface of the head frame portion. FIG. 11B is a sectional view corresponding to line 11-11 in FIG. 11A showing the multi-component spring suspension module with drilled string holes located on the outer peripheral surface of a head frame portion that has pre-formed string channel openings.

DETAILED DESCRIPTION OF THE INVENTION

According to a preferred embodiment, the present invention is intended for use as a game racket. In particular, a game racket frame comprised of at least one substantially fluid tight portion. The racket includes a handle and a head frame including at least one substantially fluid tight portion and is laced through in the conventional manner with strings held in tension to form a stringed hitting surface. At least one multi-component spring suspension module can be located on at least one of many possible locations on the head frame to cooperate with at least one string. The spring suspension module can have at least one communicating means to communicate with, i.e. via fluid displacement, at least one portion of the head frame.

Alternatively, the game racket of the present invention can be comprised of multiple substantially fluid tight parts. The separate parts can include a handle portion and a head frame portion and can have at least one communicating means on a common surface between at least two of the parts. The part that includes the head frame can have at least one substantially fluid tight portion and can be laced through in the conventional manner with strings held in tension to form a stringed hitting surface. At least one substantially fluid tight multi-component spring suspension module can communicate with, i.e. via fluid displacement, at least one portion of the head frame. The at least one spring suspension module can be located on at least one of many possible locations on the head frame to cooperate with at least one string.

The substantially fluid tight racket of the present invention, its potential components and its potential parts, can be made using methods known and taught in the previous art of reinforced plastic inflation bladder molding, including the application of newly strengthened bonding agents and related recuring and co-curing processes. The implications of such methods for improvement of string suspension applications that rely on fluid pressure retention was previously overlooked. The present invention is described herein.

Figure 1:
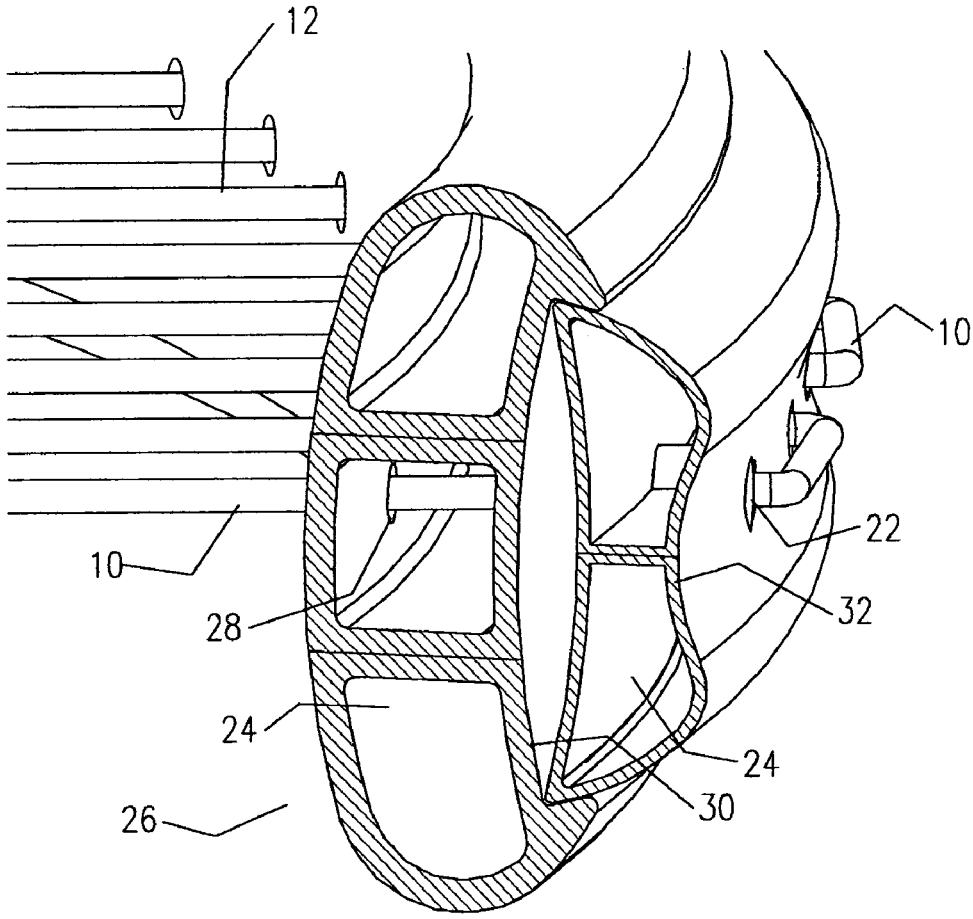
FIG. 1 shows a three-dimensional sectional view of a continuous sequence of substantially fluid tight multi-component spring suspension modules of the present invention located on an outer-facing peripheral surface of a substantially fluid tight multi-component head frame profile.

FIG. 1 shows a three-dimensional sectional view through an embodiment of a head frame 8 of the game racket of the present invention. A substantially fluid tight spring suspension module 32 is shown on an outer-facing peripheral surface 30 of the head frame profile 26. A string 10 is shown laced through the head frame profile 26 and through pre-formed string-channel opening(s) 22 in the module 32 to form a stringed hitting surface 12 on the opposing side from the module 32 of the profile 26.

Figure 2:
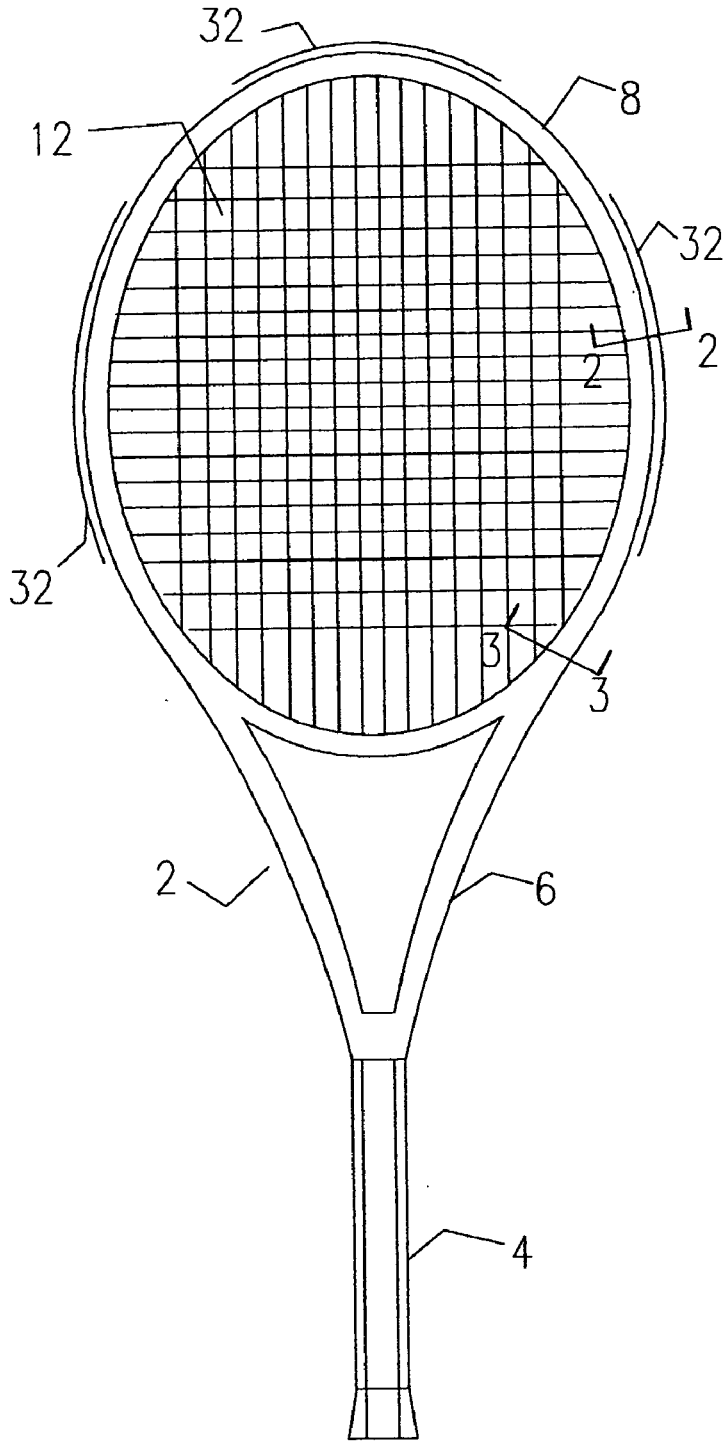
FIG. 2 shows a simplified representation of a game racket of the present invention and three possible advantageous locations on the head frame for at least one multi-component, spring suspension module.

FIG. 2 shows a simplified representation of the game racket 2 of the present invention. The racket 2 includes a handle 4 and a head frame 8 with string(s) 10 laced through and held in tension to form a stringed hitting surface 12. The racket 2 is shown here with more than one dependent multi-component spring suspension module 32 located on three different portions of the head frame 8 periphery. Though the locations suggested here are but a few of many possible locations, they correspond to positions on the head frame 8 that typically are free of string 10 knots and associated complications. Though the representational view of the racket 2 is shown with an open throat portion 6 and a generally oval-shaped stringed hitting area 12, many other configurations are possible within the parameters of the inflation bladder molding process and within which the present invention can be equally effective.

Figure 3:
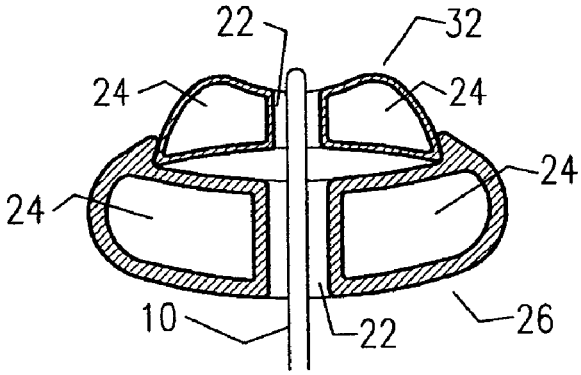
FIG. 3 shows a cross-sectional view corresponding to line 2-2 in FIG. 2 of a first preferred embodiment of a substantially fluid tight two-component head frame profile including a pre-formed string channel opening and with a multi-component spring suspension module having a pre-formed string channel opening.

FIG. 3 shows a cross-sectional view corresponding to line 2-2 in FIG. 2 of a first embodiment of a substantially fluid tight head frame profile 26. This particular profile 26 embodiment is made up of two component(s) 24 that form a string channel opening 22. The profile 26 has a two-component 24 spring suspension module 32 located on an outer facing peripheral surface 30 of the head frame 8. A string 10 is laced through a string channel opening 22 on both the spring module 32 and the head frame profile 26.

Figure 4:
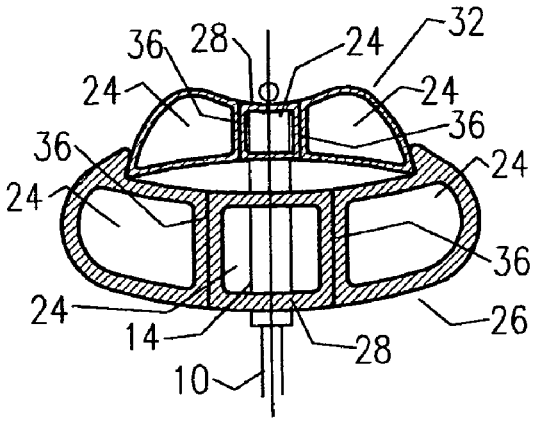
FIG. 4 shows a cross-sectional view corresponding to line 2-2 in FIG. 2 of a second embodiment of a substantially fluid tight head frame profile formed by three components including a drilled string hole and with a multi-component spring suspension module having a drilled string hole.

FIG. 4 shows a cross-sectional view corresponding to line 2-2 in FIG. 2 of a second embodiment of a substantially fluid tight head frame profile 26, and a dependent multi-component spring suspension module 32 located on the outer facing peripheral surface 30 the head frame 8. In this particular embodiment, a string 10 is shown laced through drilled string holes 28 in a three-component 24 spring module 32 and also laced through drilled string holes 28 in a three-component 24 substantially fluid tight head frame profile 26. Though there may be inherent disadvantages to this particular embodiment, such as additional weight and a shorter effective string length, its fluid retaining capacity and its ease of fabrication using conventional drilling make it a marked improvement over the previous art, particularly in regard to fluid retention based string suspension applications.

Figure 5:
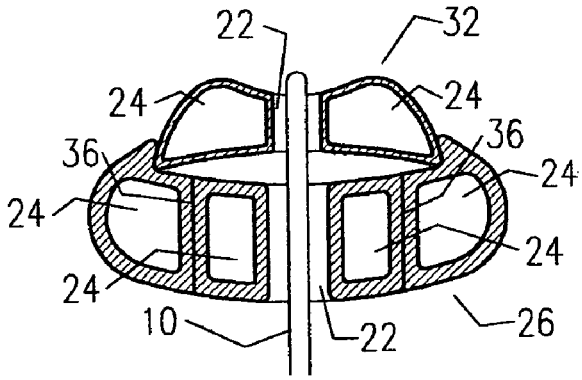
FIG. 5 shows a cross-sectional view corresponding to line 2-2 in FIG. 2 of a third embodiment of a substantially fluid tight head frame profile formed by four components including a pre-formed string channel opening and with a multi-component spring suspension module having a pre-formed string channel opening.

FIG. 5 shows a cross-sectional view corresponding to line 2-2 in FIG. 2 of a third embodiment of a substantially fluid tight head frame profile 26. This particular profile 26 embodiment is made up of four component(s) 24 that form a string channel opening 22. The profile 26 has a two-component 24 spring suspension module 32 located on an outer facing peripheral surface 30 of the head frame 8. A string 10 is laced through a pre-formed string channel opening 22 on both the spring module 32 and the head frame profile 26. Though the additional common walls of the profile 26 in this embodiment may add weight, the design is inherently free of extraneous parts and affords the potential for a lean racket. The rigidity afforded by additional common walls also may be desirable with specific regard to a racket head frame including a spring module.

While the particular embodiments described above indicate the use of a pre-formed string channel opening 22 in both the module 32 and the head frame profile 26—FIG. 3; and the use of drilled string holes 28 in both the module 32 and the head frame profile 26—FIG. 4; it is possible that the techniques involved could be combined, i.e. a module 32 with a drilled string hole 28 could be used on a head frame profile 26 with a pre-formed string channel opening 22, and vice versa. Different combinations will likely result in rackets with differing performance qualities and those with knowledge in the art will understand this with further development.

Figure 6:
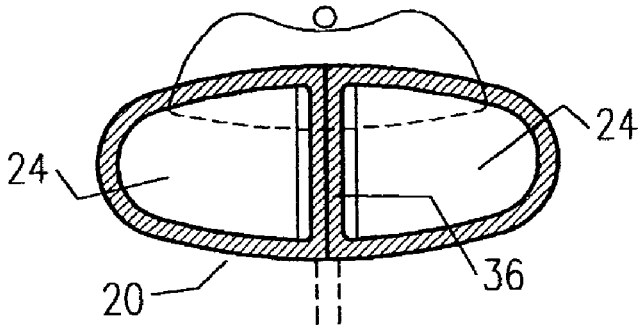
FIG. 6 shows a cross-sectional view corresponding to line 3-3 in FIG. 2 of a substantially fluid tight, two-component frame profile that can utilize a pre-formed string channel opening.

FIG. 6 shows a cross-sectional view corresponding to line 3-3 in FIG. 2 of a first embodiment of a substantially fluid tight, racket frame profile 20. This embodiment is formed by the joining of two component(s) 24 at a common wall 36 to form one unitary substantially fluid tight racket frame profile 20. The two-component 24 profile 20 shown allows the use of pre-formed string channel openings 22 on the head frame 8.

Figure 7:
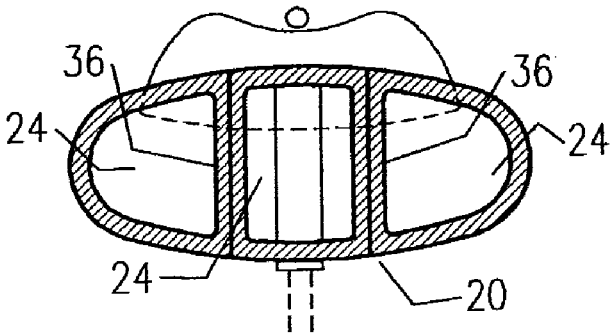
FIG. 7 shows a cross-sectional view corresponding to line 3-3 in FIG. 2 of a substantially fluid tight, three-component frame profile that can utilize a drilled string hole.

FIG. 7 shows a cross-sectional view corresponding to line 3-3 of FIG. 2 showing a second embodiment of a substantially fluid tight racket frame profile 20. This particular embodiment is formed by the joining of three component(s) 24 at least two common wall(s) 26 and is well suited to the use of drilled string holes 28 through its central component 24. Another key benefit of this profile is the added strength afforded by a second common wall 36. These profile views are intended to show some of the preferred versions of the fluid retaining vessel that is the racket of the present invention as fabricated using the latest techniques of inflation bladder molding and with the use of stronger bonding agents, many other variations are likely possible. For example, a racket frame profile and/or a head frame profile could be formed by more components as in FIG. 8.

Figure 8:
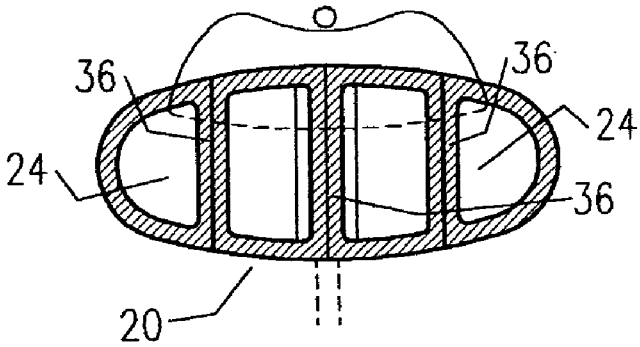
FIG. 8 shows a cross-sectional view corresponding to line 3-3 in FIG. 2 of a substantially fluid tight, four-component frame profile that can utilize a pre-formed string channel opening.

FIG. 8 shows a cross-sectional view corresponding to line 3-3 in FIG. 2 of a third embodiment of a substantially fluid tight racket frame profile 20. This embodiment is formed by the joining of four component(s) 24 at common wall(s) 36 to form one unitary substantially fluid tight racket frame profile 20. The four-component 24 profile 20 shown is particularly rigid and allows the use of pre-formed string channel openings 22 on the head frame 8.

Figure 9A:
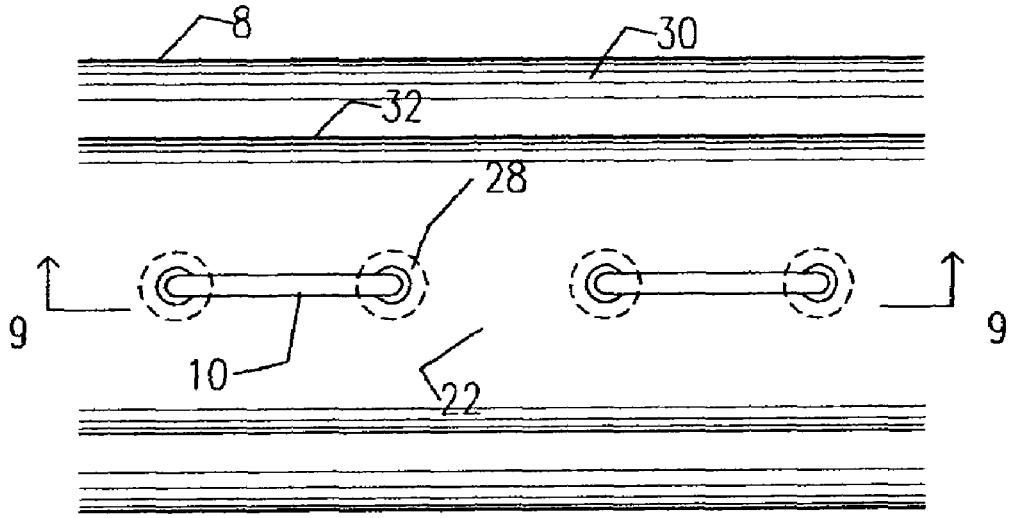
FIGS. 9A and 9B are views showing a multi-component spring suspension module with pre-formed string channel opening(s) located on a portion of a substantially fluid tight three-component head frame that includes a drilled string hole(s).
Figure 9B:
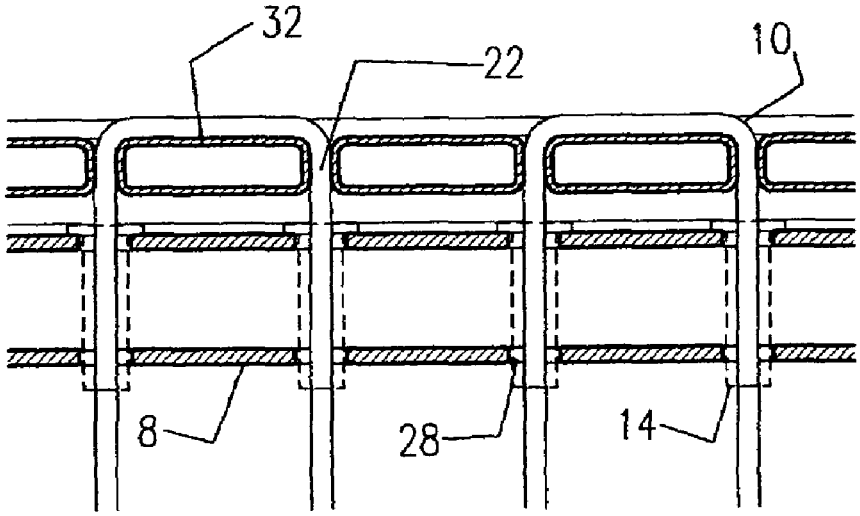

FIG. 9A shows a top view on axis with a string 10, of more than one multi-component spring suspension module(s) 32 on an outer facing peripheral surface 30 of a portion of a head frame 8 of the racket of the present invention. The string(s) 10 are shown laced through pre-formed string channel openings 22 in the dependent spring module(s) 32 and through drilled string holes 28 in the head frame 8. FIG. 9B is a sectional view corresponding to line 9-9 in FIG. 9A showing more than one multi-component spring supension module(s) 32 with pre-formed string channel openings 22 and located on an outer facing peripheral surface 30 of the head frame 8. The string(s) 10 is laced through openings 22 in the spring module 32 and through drilled string hole(s) 28 in the head frame 8. Though this embodiment requires a protective string grommet 14, its ease of fabrication using conventional drilling methods makes it a great improvement over the previous art.

Figure 10A:
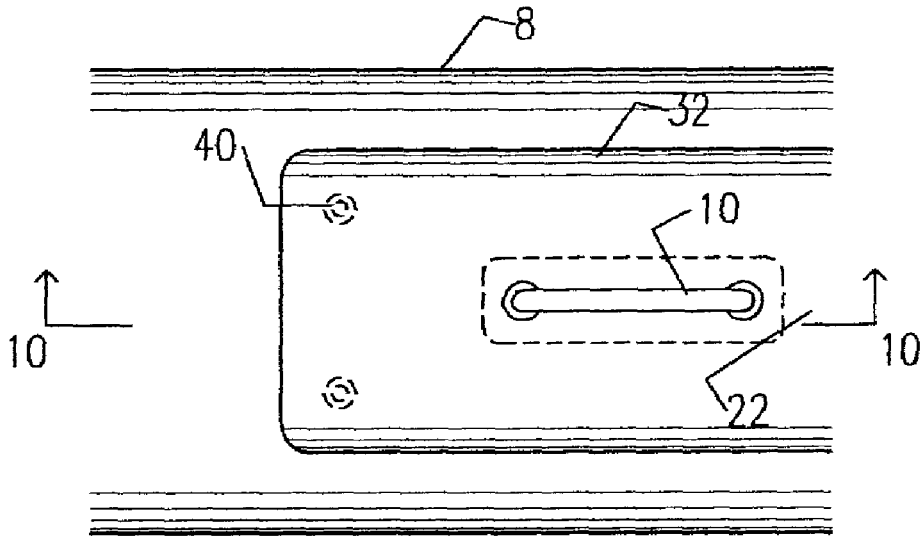
FIGS. 10A and 10B are views showing the last of a number of dependent, multi-component spring suspension module(s) that includes pre-formed string channel openings and terminating on one possible area on the outer peripheral surface of a substantially fluid tight head frame portion.
Figure 10B:
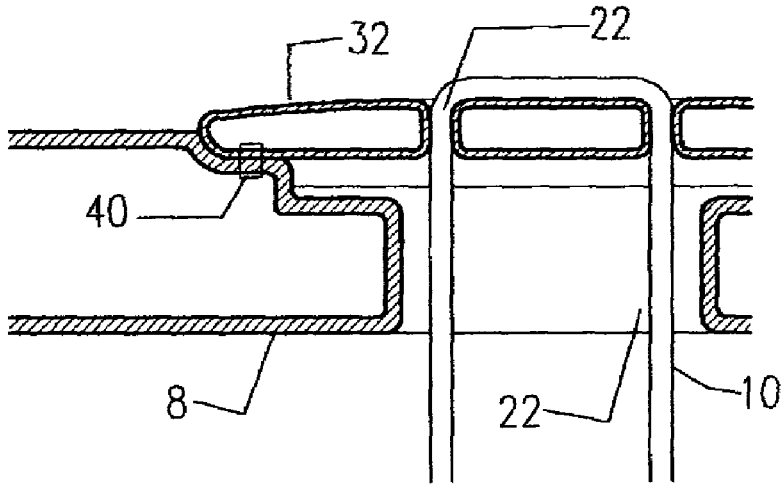

FIGS. 10A and 10B show a number of dependent, multi-component spring suspension module(s) 32 terminating on one possible area of the outer facing peripheral surface 30 of the head frame 8 of the substantially fluid tight racket 2 of the present invention. FIG. 10A is a plan view on axis with the string(s) 10, of the last of a number of dependent, multi-component spring suspension module(s) 32 located on the head frame 8 of the racket 2. At least one communicating means 40, i.e. substantially fluid tight connecting aperture, is shown in one of a number of possible locations on the head frame 8 of the racket 2. Because the string 10 laced through is in tension, it naturally can compress the spring module 32 against the head frame 8. In this example, with the communicating means 40 located between the module 32 and the outer facing peripheral surface 30 of the head frame 8, the quality of its function is enhanced. FIG. 10B is a cross-sectional view corresponding to line 10-10 in FIG. 10A, showing the last of a number of dependent multi-component spring suspension module(s) 32 terminating on one possible area of the head frame 8 of the substantially fluid tight game racket of the present invention. The at least one communicating means 40, i.e. substantially fluid tight connecting aperture, can allow fluid displacement to occur and can be located in any number of advantageous positions on a common surface between at least one dependent multi-component spring module 32 and the head frame 8. Even though the at least one communicating means 40 is shown in these examples occurring in the area of a last dependent spring module in a series of a number of modules, it could also be that the means 40 is best located nearer to the middle module in a series of a number of modules or any other of a number of advantageous locations. It is also possible that each module in a sequence has its own individual communicating means 40. It could also be that there is some benefit from having many more than one communicating means 40 and in such a way as to serve a venting and/or a exhaust function. The substantially fluid tight embodiment illustrated in FIGS. 10A and 10B is free of grommets 14 and/or bladders and is one of the lightest possible variations and therefore a preferred embodiment of the present invention.

Figure 11A:
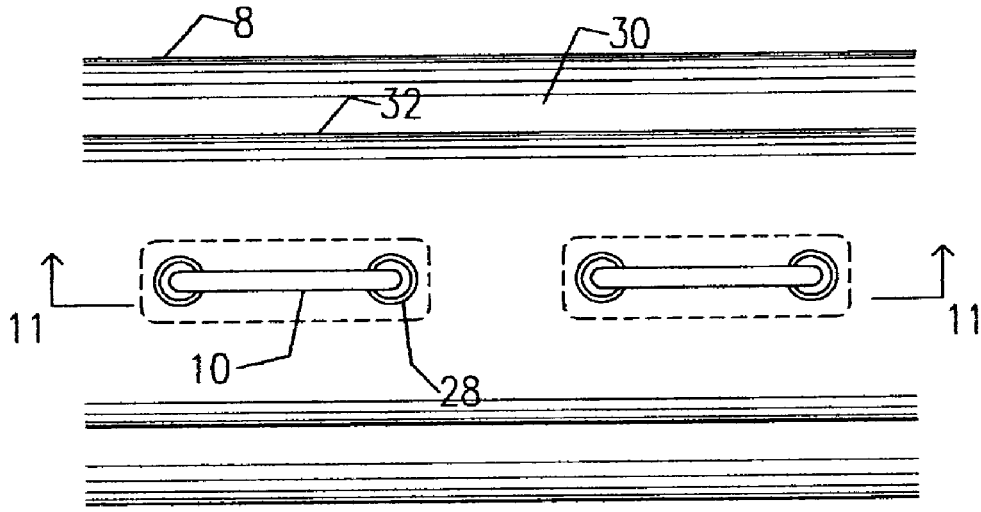
FIGS. 11A and 11B are views showing a multi-component, spring suspension module with drilled string holes and located on a portion of a substantially fluid tight head frame.
Figure 11B:
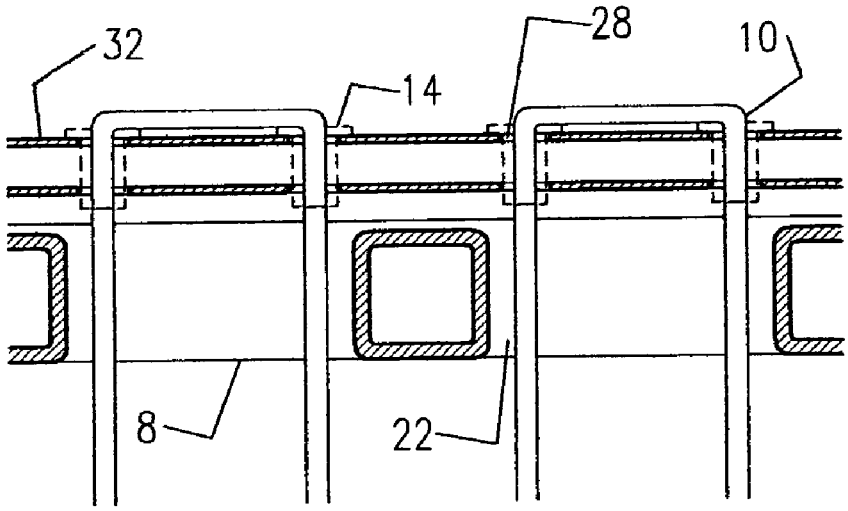

FIGS. 11A and 11B show a number of multi-component spring suspension module(s) 32 located on a portion of a head frame 8 of the substantially fluid tight racket 2 of the present invention. FIG. 11A is a top view of the module(s) 32 located on an outer facing peripheral surface 30 of the head frame 8 of the racket 2. The module 32 includes a number of drilled string holes 28 with a string 10 laced through. FIG. 11B is a sectional view corresponding to line 11-11 in FIG. 11A, of a module 32 located on an outer facing peripheral surface 30 of a portion of the head frame 8. The multi-component module 32 has a number of drilled string hole(s) 28 drilled through its central component 24 requiring a grommet 14. A string 10 is laced through both the module 32 and through pre-formed string channel opening(s) 22 on the head frame profile 26. Though this configuration requires a grommet 14 and is therefore heavier than other versions, there may be other performance related qualities that make the use of this design desirable.

Figure 12:
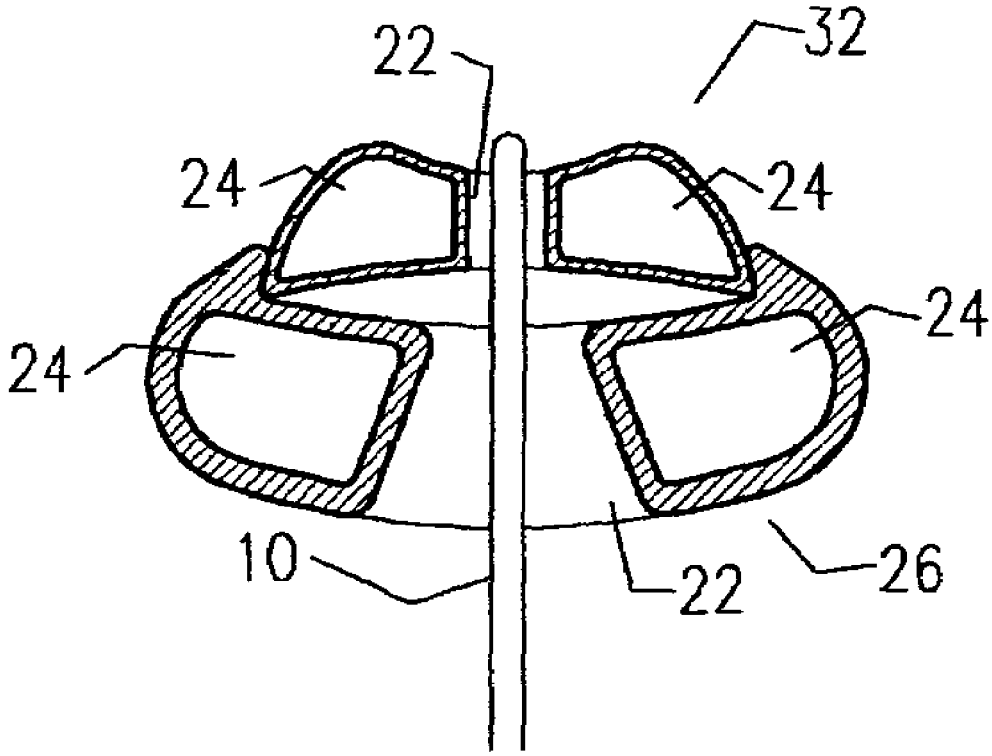
FIG. 12 is a cross-sectional view corresponding to line 2-2 in FIG. 2 showing another embodiment of a substantially fluid tight multi-component spring suspension module located on a portion of a substantially fluid tight head frame profile that includes a truncated cone-shaped pre-formed string channel opening.

FIG. 12 is a cross-sectional view corresponding to line 2-2 in FIG. 2 showing an alternative embodiment of a substantially fluid tight two-component head frame profile 26. The profile 26 has two-component spring suspension module 32 with a pre-formed string channel opening 22 located on its outer facing peripheral surface 30. A pre-formed string channel opening 22 is shown in the profile 26 with a truncated cone-shape wherein the end of the channel opening 22 nearer to the outer facing surface 30 of the profile 26 is generally smaller than the channel opening 22 end nearer to the stringed hitting surface 12. This particular configuration has obvious advantages in allowing a range of maximum string 10 deflection. It may also be possible and may have performance advantages to have a truncated cone-shaped pre-formed string channel opening 22 in the suspension module 32 as well.

Figure 13:
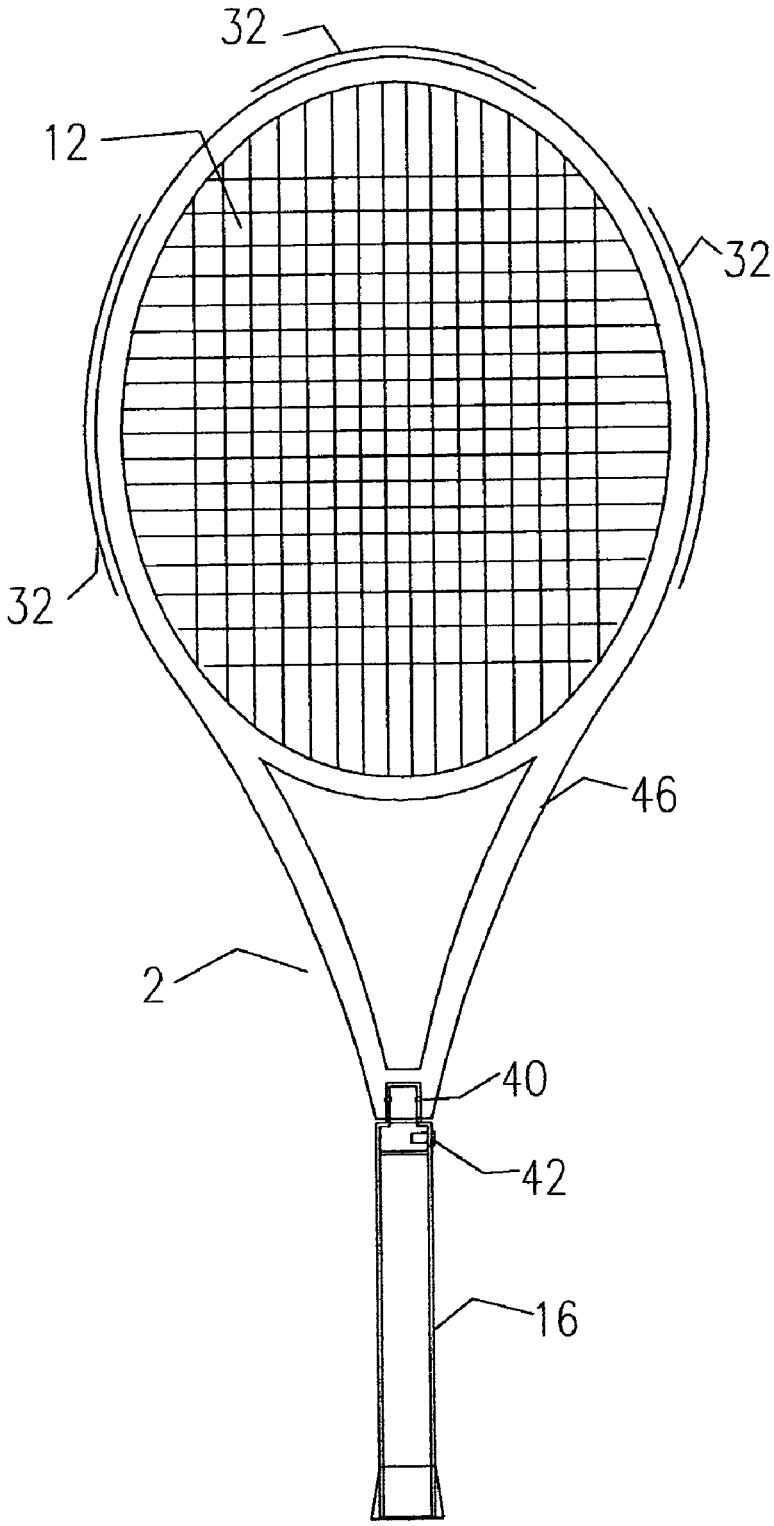
FIG. 13 shows a simplified representation of a first embodiment of a game racket formed of multiple substantially fluid tight parts including a handle part and a head frame/throat part. One of many possible locations for a control means is shown here on the handle part.

FIG. 13 shows a simplified representation of another embodiment of the present invention. The racket frame 2 is comprised of two substantially fluid tight parts, a handle part 48 and a throat/head part 46. The parts can be joined together and can share at least one communicating means 40, ie substantially fluid tight connecting aperture, at the location of their common surfaces. A control means 42, ie valve or hydraulic actuator, can be conveniently located in any one of a number of possible locations on at least one of the fluid tight parts. The location shown here is on the handle part 48. This embodiment would also be particularly advantageous from a maintenance standpoint. For example, if the control means 42 were to malfunction, only the handle part 48 would have to be replaced, instead of the entire racket frame 2.

Figure 14:
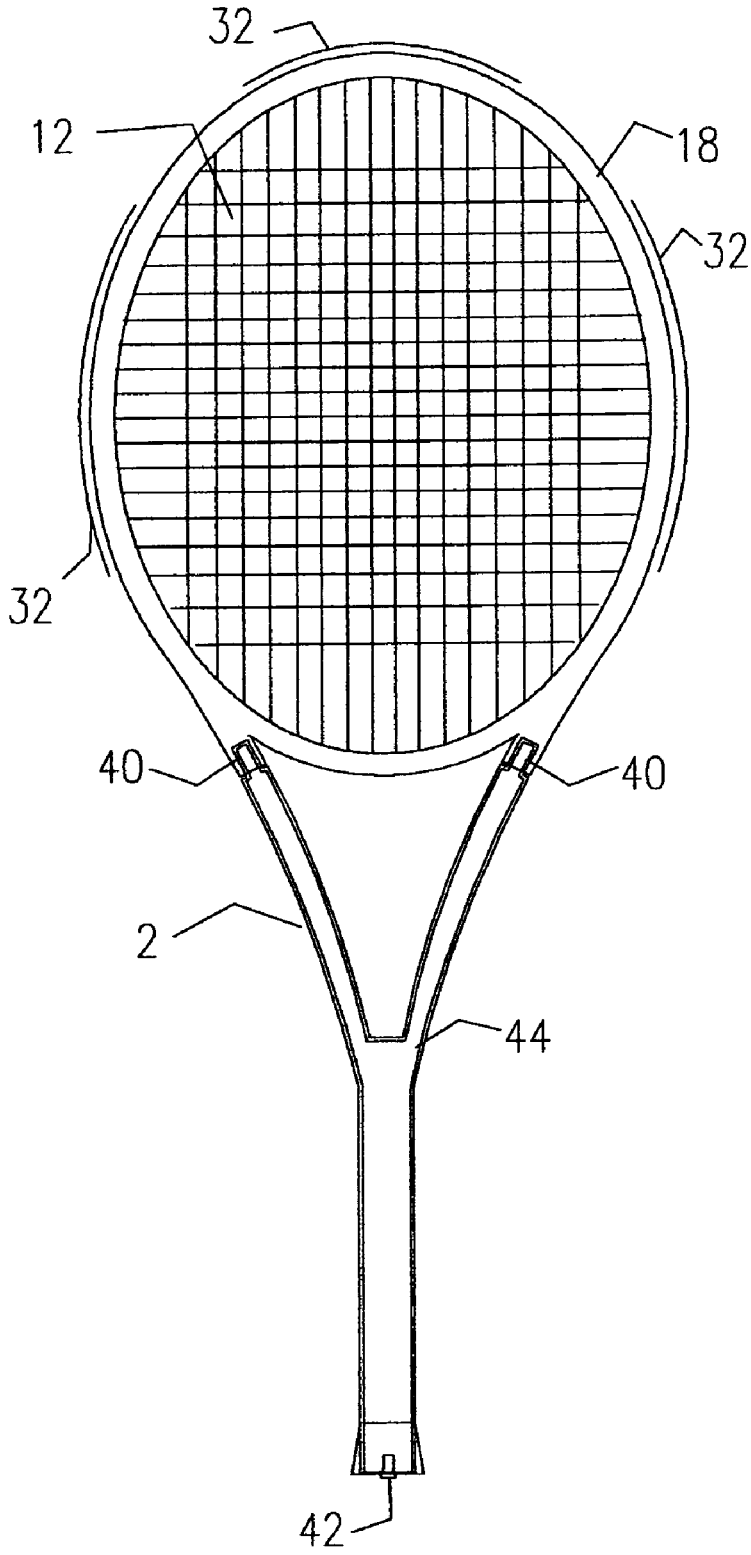
FIG. 14 shows a simplified representation of a second embodiment of a game racket formed of multiple substantially fluid tight parts including a handle/throat part and a head frame part. Another of many possible locations for a control means is shown here on the handle/throat part.

FIG. 14 shows a simplified representation of another embodiment of the present invention. The racket frame 2 is comprised of two substantially fluid tight parts, a handle/throat part 44 and a head frame part 50. The parts can be joined together and can share at least one communicating means 40, i.e. substantially fluid tight connecting aperture, at the location of their common surfaces. A control means 42, i.e. valve or hydraulic actuator, can be located on any one of a number of convenient locations on at least one of the substantially fluid tight parts. This particular embodiment shows the control means 40 on the handle/throat part 44. This embodiment is also particularly advantageous from a maintenance standpoint. For example, if the control means 42 were to malfunction, only the handle/throat part 44 would have to be replaced, instead of the entire racket frame 2. Another example is if the head frame part 50 were to be damaged and/or punctured, a new one could replace it to be re-joined with the handle/throat part 44. Other variations are possible and will become apparent to those skilled in the art.

Though the drawings are intended to describe some of the preferred embodiments of the invention, the scope of the ideas embodied in them should not be limited merely to the drawings themselves but rather considered a representational depiction. Other variations are possible and will become apparent to those skilled in the art. Accordingly, the present invention is not intended to be limited by the recitation of embodiments, but is intended to be defined by reference to the appended claims.

What is claimed is:

1. A game racket comprising:

at least one substantially fluid tight portion, wherein the racket has a handle and a head frame, the head frame including at least one substantially fluid tight portion and laced through with at least one string held in tension to form a stringed hitting surface, the head frame further comprising at least two substantially fluid tight components; and at least one generally tubular, substantially fluid tight spring suspension module located on at least one portion of the head frame such that the spring suspension module cooperates with the at least one string and is formed by at least two generally tubular components having at least one common bonding wall between the components thereby forming a structurally contiguous and unitary profile.

2. The racket according to claim 1 wherein at least the head frame has a unitary profile formed by at least two components being mated to form at least one through string channel opening.

3. The racket according to claim 2 wherein at least one string channel opening is on axis with and parallel to a string end.

4. The racket according to claim 2 wherein at least one string channel opening is a truncated cone-shape.

5. The racket according to claim 1 wherein the components of the spring suspension module are preformed with at least one through string channel opening.

6. The racket according to claim 5 wherein at least one string channel opening is on axis with and parallel to a string end.

7. The racket according to claim 5 wherein at least one string channel opening is a truncated cone-shape.

8. The racket according to claim 1 wherein the components of the spring suspension module are filled with at least one dampening or tension material.

9. The racket according to claim 8 wherein the material is a liquid, gas, or vapor.

10. The racket according to claim 8 wherein the material is foam.

11. The racket according to claim 8 wherein the material is elastomeric.

12. The racket according to claim 1 wherein the racket has a valve that manipulates fluid pressure in the racket by adding or withdrawing fluid.

13. The racket according to claim 1 wherein the racket has a hydraulic piston-type actuator that manipulates fluid pressure in the racket.

14. The racket according to claim 1 wherein the racket manipulates the stiffness of the spring suspension module by pressure changes transferred from the racket to the spring suspension module.

15. The racket according to claim 1 wherein the spring suspension module has at least one exhaust aperture on at least a side portion facing away from the racket frame.

16. A game racket comprising at least one substantially fluid tight handle portion, throat portion, or head frame portion wherein the head frame portion is laced through with at least one string held in tension to form a stringed hitting surface; and at least one generally tubular, spring suspension module located on at least one portion of the head frame such that the spring suspension module cooperates with the at least one string and has a profile formed by at least two components with at least one common wall.

17. The racket according to claim 16 wherein the racket manipulates the stiffness of the spring suspension module by pressure changes transferred from the racket to the spring suspension module.

18. The racket according to claim 16 wherein when more than one part forms the racket frame a pressure change within the racket is transferred between at least two parts of the racket frame.

19. The racket according to claim 16 wherein fluid pressure in the racket is manipulated from the handle of the racket frame.

20. The racket according to claim 19 further comprising a valve that adds or withdraws fluid.

21. The racket according to claim 19 further comprising a hydraulic piston-type actuator.

22. The racket according to claim 16 wherein the components of the spring suspension module are preformed with at least one through string channel opening.

23. The racket according to claim 22 wherein at least one string channel opening is a truncated cone-shape.

24. The racket according to claim 16 wherein the components of the spring suspension module profile are mated to form at least one through channel opening for the string.

25. The racket according to claim 24 wherein at least one string channel opening is a truncated cone-shape.

26. The racket according to claim 16 wherein the components of the spring suspension module are filled with at least one dampening or tension material.

27. The racket according to claim 26 wherein the material is a liquid, gas, or vapor.

28. The racket according to claim 26 wherein the material is foam.

29. The racket according to claim 26 wherein the material is elastomeric.

30. The racket according to claim 16 wherein the spring suspension module has at least one exhaust aperture on at least a side portion facing away from the racket frame.

31. The racket according to claim 16 wherein fluid pressure in the racket is manipulated from the throat of the racket frame.

32. The racket according to claim 16 wherein fluid pressure in the racket is manipulated from the head of the racket frame.

* * * * *